US007252109B2

(12) United States Patent
Colombo

(10) Patent No.: US 7,252,109 B2
(45) Date of Patent: Aug. 7, 2007

(54) SAFETY DEVICE FOR A LIGHTING VALVE OF A GAS BURNER

(75) Inventor: Pierangelo Colombo, Gallarate (IT)

(73) Assignee: Industrias Unidas S.A. DE C.V. (MX)

( * ) Notice: Subject to any disclaimer, the term of this patent is extended or adjusted under 35 U.S.C. 154(b) by 300 days.

(21) Appl. No.: 11/102,275

(22) Filed: Apr. 8, 2005

(65) Prior Publication Data

US 2005/0233273 A1 Oct. 20, 2005

(30) Foreign Application Priority Data

Apr. 8, 2004 (IT) ..... TO2004A0218

(51) Int. Cl.
*F23Q 9/08* (2006.01)
*F23D 14/72* (2006.01)

(52) U.S. Cl. ..... 137/66; 137/614.19; 137/614.21; 431/54

(58) Field of Classification Search ..... 137/66, 137/65, 614.19, 614.21; 431/54, 53
See application file for complete search history.

(56) References Cited

U.S. PATENT DOCUMENTS 2,297,856 A * 10/1942 Ames ..... 431/59
4,081,235 A * 3/1978 van der Veer ..... 431/54
4,242,080 A * 12/1980 Tabei ..... 431/54
4,442,853 A * 4/1984 Gort ..... 137/66
6,886,581 B2 * 5/2005 Harniet ..... 137/66

* cited by examiner

*Primary Examiner*—Kevin Lee
(74) *Attorney, Agent, or Firm*—Baker & McKenzie LLP

(57) ABSTRACT

A safety device (61) for a lighting valve (23) of a gas burner, comprising a starting button (36), a return spring (57), a cutoff shutter (42) controlled by the starting button (36), a control shutter (41) for a pilot light nozzle, and a holding electromagnet (54) for the control shutter (41). The control shutter (41) is normally closed and is actuatable through the starting button (36) for the flowing of the gas to the pilot light nozzle, whilst the holding electromagnet (54) is dependent on the pilot light to hold open the control shutter (41). The starting button (36) is provided for rotation and can be depressed only for a given angular start position so that, for starting the lighting, the button (36) must be rotated up to said start position and subsequently depressed to close the cutoff shutter (42) and open the control shutter (41). There are provided a hooking condition and an unhooked condition for the starting button: in the hooking condition, the cutoff shutter (42) is closed and the control shutter (41) is open under the control of the holding electromagnet (54) without being influenced by the starting button (36); and, in the unhooked condition, the starting button (36) can return to the lifted position to open the cutoff shutter (42) for the flowing of the gas to the burner, the unhooked condition requiring a further rotation of the starting button (36) spaced away from the angular start position.

16 Claims, 8 Drawing Sheets

SAFETY DEVICE FOR A LIGHTING VALVE OF A GAS BURNER

PRIORITY CLAIM AND RELATED APPLICATIONS

This application claims priority to Italian Patent Application No. TO2004A000218 entitled "Dispositivo di sicurezza per valvola d'accension di un bruciatone a gas" filed Apr. 8, 2004, incorporated herein by reference.

FIELD OF THE INVENTION

The present invention relates to a safety device for a lighting valve of a gas burner, exemplary for water heaters.

More specifically, the invention relates to a safety device for a lighting valve of a gas burner, exemplary but not exclusively, for domestic water heaters, comprising a starting button, a control shutter actuatable through the starting button and a cutoff shutter controlled by the starting button, according to the introductory portions of the principal claims.

BACKGROUND OF THE INVENTION

A gas water heater generally provides a control pilot light for the main burner, a regulating device for the burner controlled by manual controls and by the temperature of the water and a safety device, which prevents the flowing of the gas to the burner in the case of turning off the pilot light.

Although water heaters with burners provided of piezoelectric or electronic type lighting devices are normally on sale, water heaters having flame lighting system for the gas burners are still commonly produced.

In a safety device for a gas water heater of known type, the cutoff shutter is downstream of the control shutter and upstream of a thermostatic shutter for the main burner. The control shutter is also controlled by a holding, electromagnet, in turn fed by the current of a thermocouple heated by the pilot flame. The thermostatic shutter is adjustable through a knob, which further provides a given start position, of minimum feed, for the gas burner.

In the condition of rest, the cutoff shutter is open and the control shutter is closed. When is depressed, the starting button closes the cutoff shutter and opens the control shutter. In this condition, the user can light the pilot light whilst, for the action of the thermocouple, the electromagnet holds open the control shutter. A following lifting of the button opens the cutoff shutter and allows the flow of the gas to the burner under the control of the thermostatic shutter and its automatic lighting by the pilot light.

The known safety device is generally effective to prevent the feeding of the main burner before the lighting of the pilot light, avoiding risks of saturation of the combustion chamber and consequent bursts. Nevertheless, the phase of starting of a lighting valve can be source of problems, particularly in the cases in which the user manually lit the pilot light by means of matches, lighters and free flames. A particular risk arises when the thermostatic shutter is open and the user unintentionally releases the starting button before moving away the hand from the area of the pilot light. A sudden lighting of the main burner during the return to rest of the button can cause fear and burns in the most unfavorable cases.

However, also if a water heater provides a piezoelectric or electronic system for the lighting of the pilot light, the safety device above described can cause problems. It may depend on improper sequences in the depression/lifting operations of the starting button and/or to anomalies in the functioning of the system, with hazards of leaks of gas in the combustion chamber and consequent hazards of bursts.

SUMMARY OF THE INVENTION

An object of the invention is to accomplish a safety device for a lighting valve of gas burners, exemplary for water heaters, which assures high security standards together with easiness of operations for the user.

This object is attained by the safety device for lighting valve of a gas burner, exemplary for domestic water heaters according to the characteristic portions of the principal claims.

BRIEF DESCRIPTION OF THE DRAWINGS

The characteristics of the invention will become clear from the description that follows, provided merely by way of non-restrictive example, with the aid of the accompanying drawings, in which.

DESCRIPTION OF THE PREFERRED EMBODIMENTS

Figure 1:
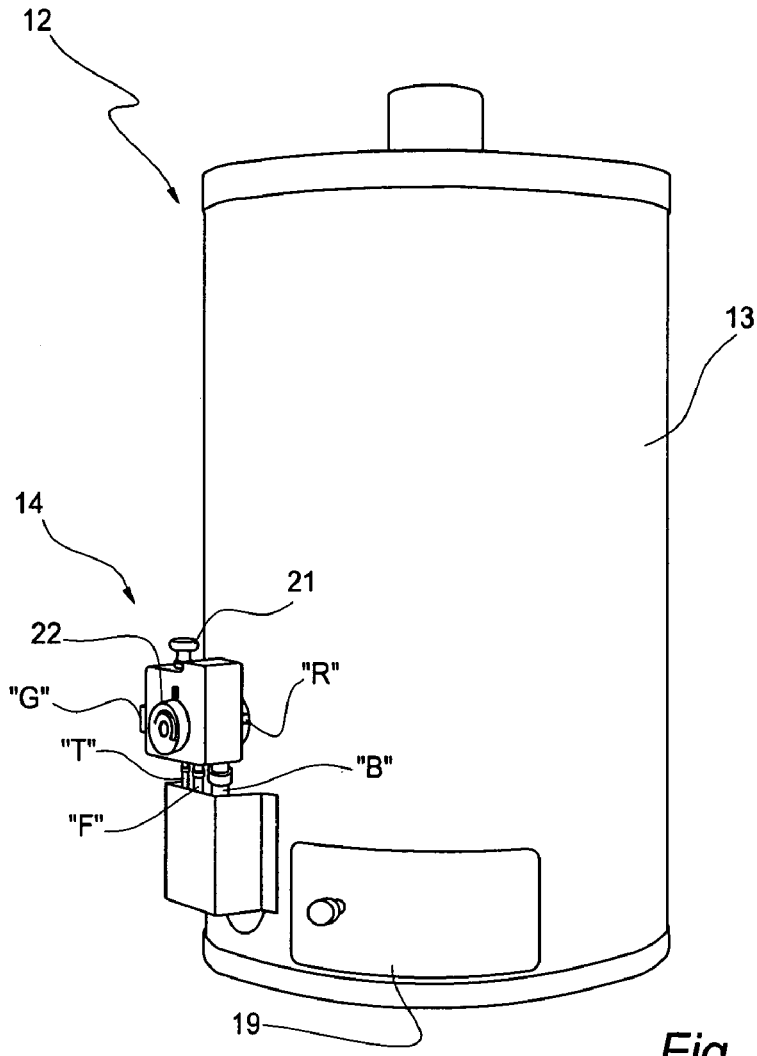
FIGS. 1 and 1*a* show schematic views of a water heater with a relative lighting valve and a gas burner of known type.
Figure 1A:
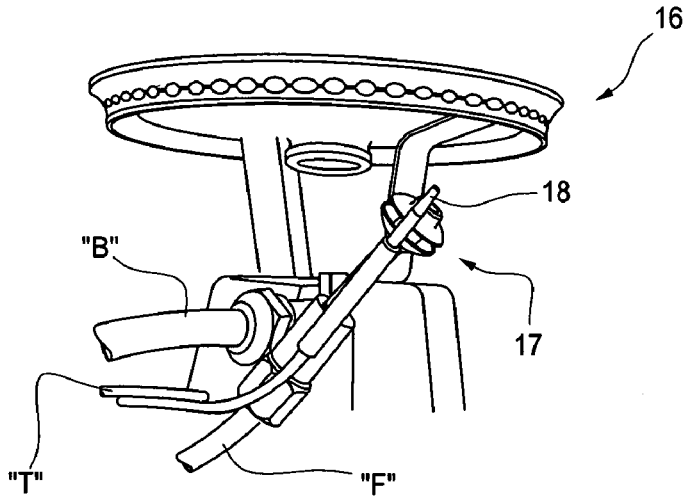

FIG. 1 represents a gas water heater 12 for domestic use of known type. The water heater 12 includes a container 13 and a lighting valve 14 and provides a combustion chamber with a main burner 16 (FIG. 1*a*), a nozzle 17 for a pilot light and a thermocouple 18 inside the container 13. The thermocouple is located in the path of the pilot flame and is electrically connected to leads protected by a tubular element "T". The water heated by the burner 16 is accumulated in a reservoir not shown in the figures and a (not shown) thermostat through a conduit "R" controls its temperature.

The lighting valve 14 is outside the water heater 12, whilst the nozzle 17 for the pilot light is accessible through a door 19 of the container 13. The gas, as methane, liquid gas etc. enters into the valve 14 through an input pipe "G" and the valve 14 feeds the nozzle 17 through a pipe "F" and the burner 16 through a pipe "B". The valve 14 is connected with the thermocouple 18 and the thermostat through the leads of the element "T" and through the conduit "R", respectively. In particular, the lighting valve 14 includes a starting button 21 for the feeding of the pilot light and a knob 22 for regulating the temperature of the water in the reservoir.

Figure 2:
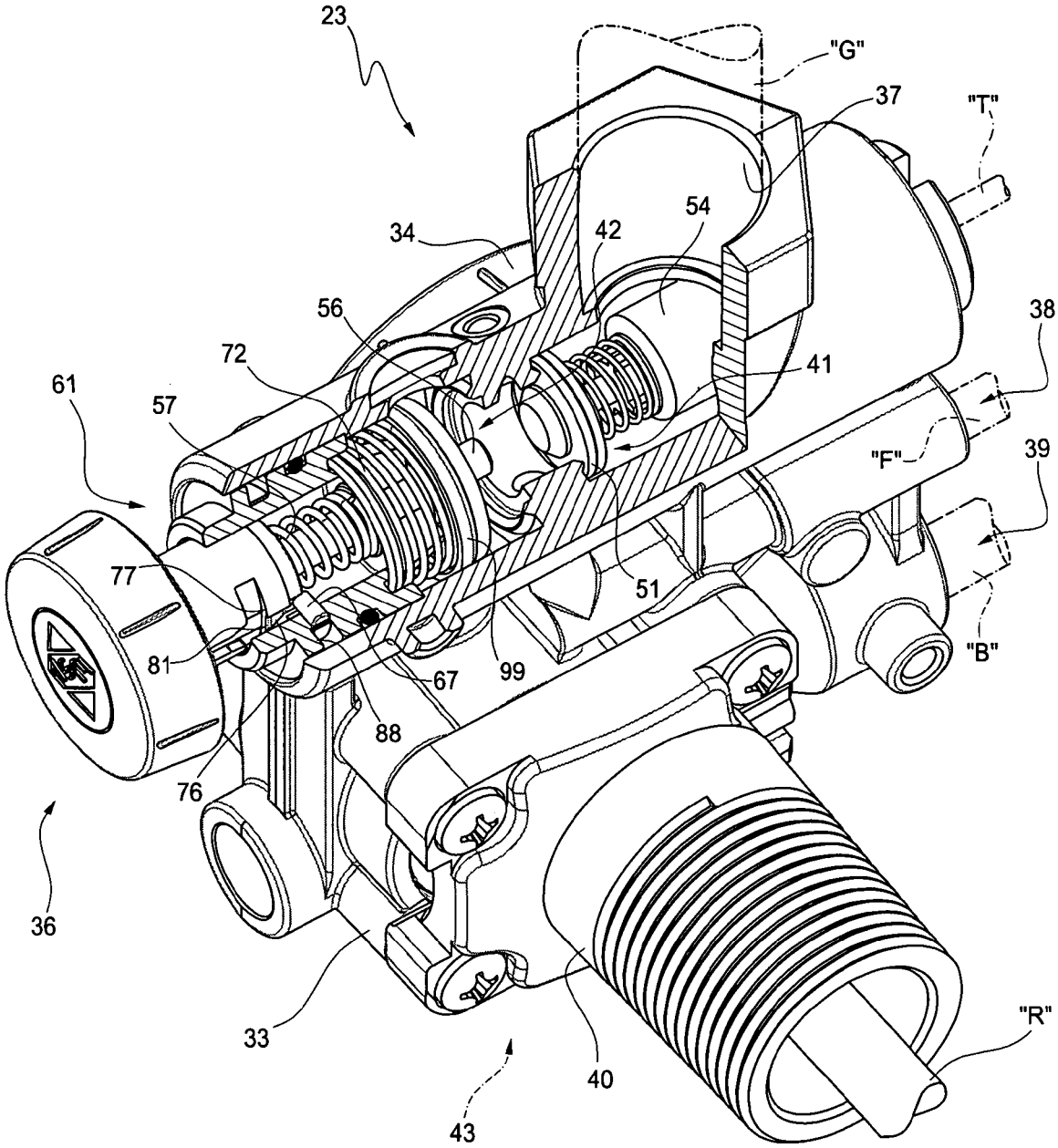
FIG. 2 shows a perspective view, partially sectioned, of a lighting valve of a gas burner with a safety device for the water heater shown in FIG. 1, according to the invention.

FIG. 2 shows a lighting valve 23, which can replace the known valve 14 of FIG. 1 and to which the safety device of the invention is applied. The lighting valve 23 includes a valve body 33, a control knob 34 similar to the knob 22, and a starting button 36.

An inlet 37, ducts 38 and 39 and a sleeve 40 for the conduit "R" of the thermostat are evident in the valve body 33. The inlet 37 is connectable with the input pipe "G", whilst the duct 38 is connectable with the pipe "F" for the nozzle of the pilot light and the duct 39 is connectable with the pipe "B" for the burner. Further, the valve body 23 lodges a control shutter 41, a cutoff shutter 42 and a thermostatic shutter 43 (FIG. 3), all of disk type.

The inlet 37, and the ducts 38 and 39 are connected each the other through an input chamber 44, an intermediate chamber 46 and a cutoff chamber 47, respectively. The input chamber 44 is gas connected with the inlet 37; the intermediate chamber 46 is interposed between the chambers 44 and 47 and is in gas connection with the duct 38 for the nozzle of the pilot light; and the cutoff chamber 47 is gas connected with the duct 39 for the burner.

The chambers 44 and 47 lodge the control shutter 41 and the cutoff shutter 42, respectively. The output of the input chamber 44 and the input of the cutoff chamber 47 are delimited by shutter seats 48 and 49 for the disks of the shutter 41 and of the shutter 42 and these seats put the intermediate chamber 46 in gas connection with the chambers 44 and 47. The seats 48 and 49 are of circular section, parallel each the other and substantial coaxial.

The control shutter 41 is in axis with the seat 48 and comprises a gastight disk 51 and a contrast head 52 mounted on a free end of an actuating stem 56. The disk 51 normally closes the seat 48 for the action of a spring 53, whereby preventing, in the use, the flowing of the gas from the input chamber 44 to the intermediate chamber 46 and, therefore, to the pilot light nozzle 17 and to the main burner 16 (see FIG. 1*a*).

The valve body 33 further provides, along the duct 39 and downstream of the cutoff chamber 47, a chamber and a respective seat, not shown in the figures, for the thermostatic shutter 43. The shutter 43 is operatively connectable with the thermostat of the water heater 12 through the conduit "R" and with the control knob 34 for controlling the flowing of the gas to the burner 16 as function of the temperature of the water and the position of the knob 34, in a well known manner.

The cutoff shutter 42 can be opened solely when the pilot light is on and the starting button 36 is lifted. Specifically, the valve 23 includes an electromagnet 54 for the control shutter 41 which is electrically connectable with the thermocouple 18 through the leads of the element "T". The electromagnet 54 is such to hold back the disk 51 in an open condition and at an end stop, against the action of the spring 53, when the pilot light heats the thermocouple according to a known technique.

In the starting button 36, the actuation stem 56 is in axis with the seat 49 and supports the cutoff shutter 42 and a return spring 57. At rest, the spring 57 maintains the starting button 36 in the lifted position and the cutoff shutter 42 in an open condition. Moreover, a free end of the stem 56 is arranged in front of the contrast head 52 of the control shutter 41. These components are dimensioned so that the complete depression of the button 36 up to the end stop of the electromagnet 54 causes the closing of the seat 49 by the shutter 42 and, in sequence, the shifting of the gastight disk 5. Thus, the shutter seat 48 will be opened for the feeding of the pilot light nozzle 17 in a condition of cutoff of the gas for the burner 16.

With the lighting of the pilot light and the button 36 depressed, the electrical current produced by the thermocouple 18 energizes the electromagnet 54. It holds open the control shutter 41, with flowing of the gas into the intermediate chamber 46 and the cutoff chamber 47. The lifting of the button 36 does not modify the state of the shutter 41 but causes the opening of the cutoff shutter 42 with flowing of the gas to the main burner under the control of the thermostatic shutter 43 and its lighting by the pilot light.

According to the invention, the safety device, depicted with 61, has such a structure to start the lighting according to an univocal procedure which ensures conditions of total protection for the user. Specifically, the depression of the starting button 36 is subordinated to a given condition of alignment, through rotation, at a predetermined angular start position. This depression causes a hooking condition, in which the cutoff shutter 42 is closed and the control shutter 41 is under the control of the thermocouple 18.

An unhooking condition, in which the starting button 36 is released for its lifting by the return spring 57 is subordinated to a further rotation of the button. In the unhooked condition, the cutoff shutter 42 is open, whilst the control shutter 41 remains under the control of the thermocouple 18.

The structure of the invention prevents any uncontrolled lighting of the gas in the chamber of combustion. In fact, also in the case in which the thermostatic shutter 43 is open and the user releases the starting button 36 before moving away the hand from the area of the pilot light, the main burner 16 is isolated from the inlet 37 in view of the hooking condition of the button. With safe, the gas can be lit only after the deliberate action of rotation by the user such to enable the releasing of the starting button 36.

Figure 10:
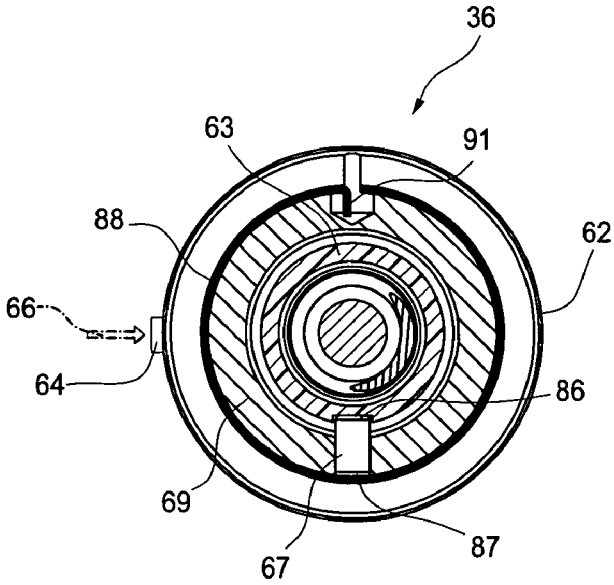
FIG. 10 shows a section according to the line X-X of the group of FIG. 5.

In detail and with reference to the FIGS. 5-8, the lighting starting button 36 includes a head 62 with a hub 63 fixed to the end of the actuating stem 56 opposite to the free end. The head 62 has a projection 64 which is lined up with an index 66 of the valve body 33 (see FIG. 10) when the button 36 is at the angular start position of the button 36 to give a visual indication of the reached start position.

The safety device 61 includes a pin element 67 arranged in an angularly fixed position with respect to the starting button 36 and adapted to cooperate with the hub 63 to define the above described procedure of start.

The device 61 is integrated in a starting group 68 comprising a guide sleeve 69 for the actuating stem 56 and stop elements 71 mounted adjacent to the free end of the stem 56. The cutoff shutter 42 is slidably mounted on the stem 56 and is arrested against the stop elements 71 by a holding spring 72 opposed by the guide sleeve 69.

The hub 63 of the button 36 has a cylindrical surface 73 providing a recessed terminal section 74, a longitudinal notch 76 and a transversal notch 77. The recessed section 74 is limited by an annular shoulder 78 (see FIG. 8) and the longitudinal notch 76 begins from the shoulder 78 and continues for a certain portion of the surface 73. The transversal notch 77 crosses the notch 76 and extends symmetrically through about 30°, whilst the longitudinal notch 76 extends beyond the notch 77 in a final section 79.

The longitudinal notch 76 is defined by two sides of guide and by a bottom that begins from the recessed section 74 and proceeds with an inclined ramp-like section toward the surface 73 and with a descending step section 81 to which follows a basis section 82 adjacent to the step section 81. The inclined section is such that the distance from the longitudinal axis starting button 36 increases in the sense of depression of the button.

The transversal notch 77 includes two guide margins and a bottom which is defined by the basis section 82 and by two inclined sections 83*a* and 83*b*, ascending to the surface 73. Thus, the distance of the bottom from the longitudinal axis of the button 36 along the transversal notch increases, with the increasing of the distance from the axis of the longitudinal notch 76. In turn, the guide margin close to the reduced section 74 is substantially coplanar with the step section 81.

Figure 9:
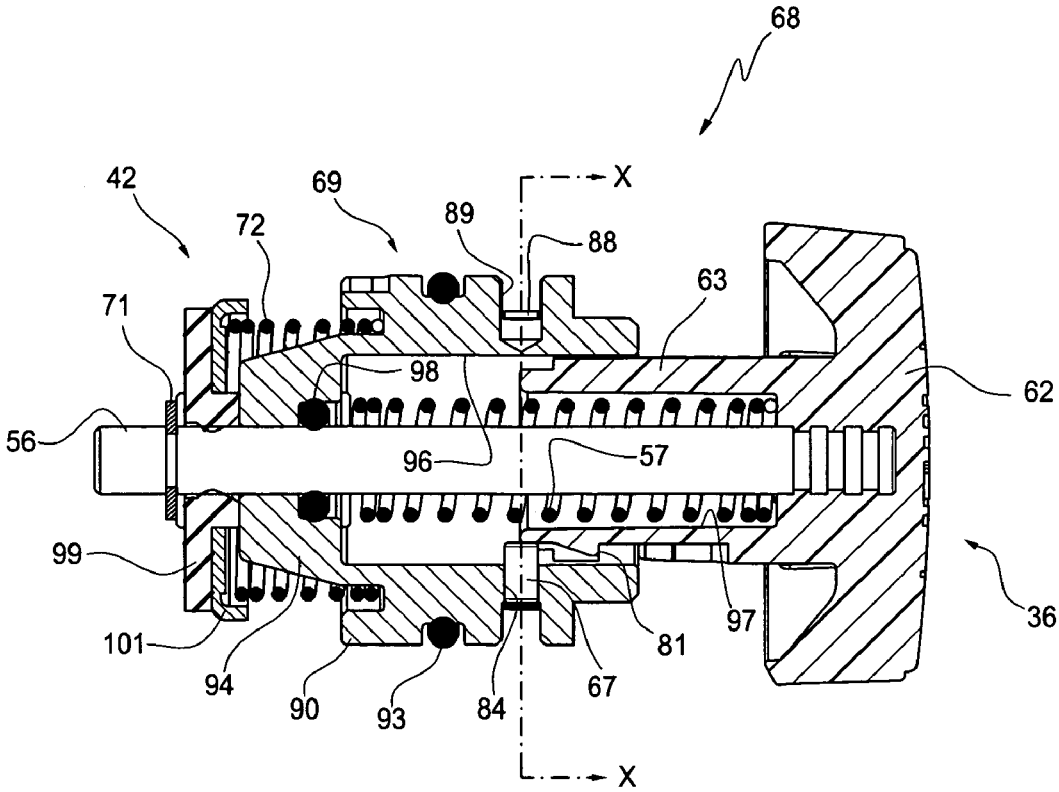
FIG. 9 is a schematic sectioned view of the component group of FIG. 5.

A seat 84 of the sleeve 69 (see FIG. 9) lodges the pin element 67 with possibility of radial shifting perpendicular to the axis of the starting button 36. A conventional inside end 86 of the pin 67 cooperates with the hub 63 and an external end 87 cooperates with a radially acting spring 88, which pushes the pin element 67 toward the longitudinal axis of the button 36.

In an initial condition, corresponding to the lifted position of the starting button 36, the inside end 86 of the pin 67 projects from the seat 84 and engages the recessed terminal section 74 of the hub 63 in front of the annular shoulder 78. It prevents the depression of the button 36 as represented in the configuration "I" shown in FIG. 6 and in FIG. 11.

Figure 6:
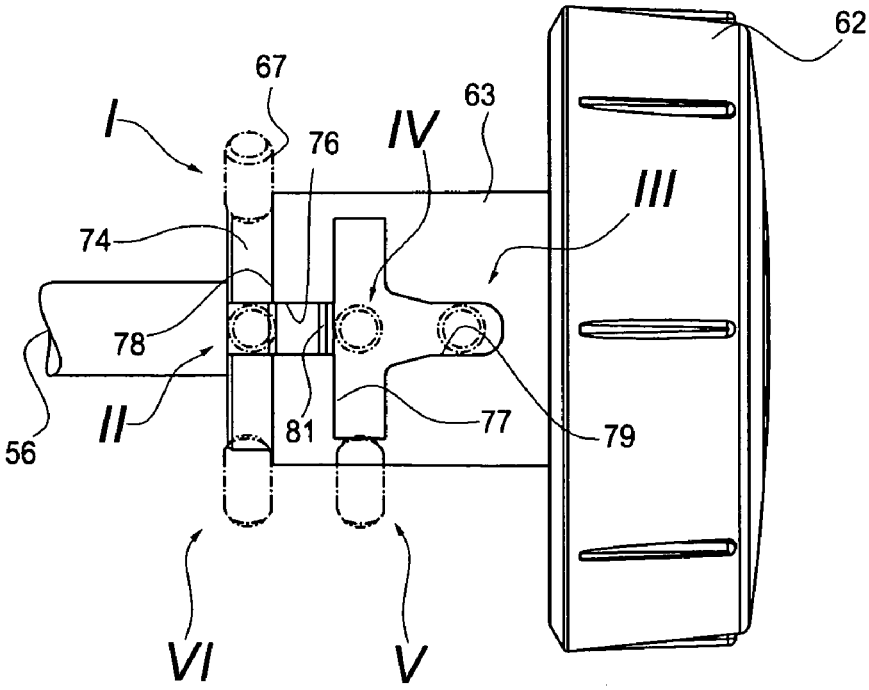
FIG. 6 shows a scheme of operation of a detail of the group of FIG. 5.
Figures 7, 8:
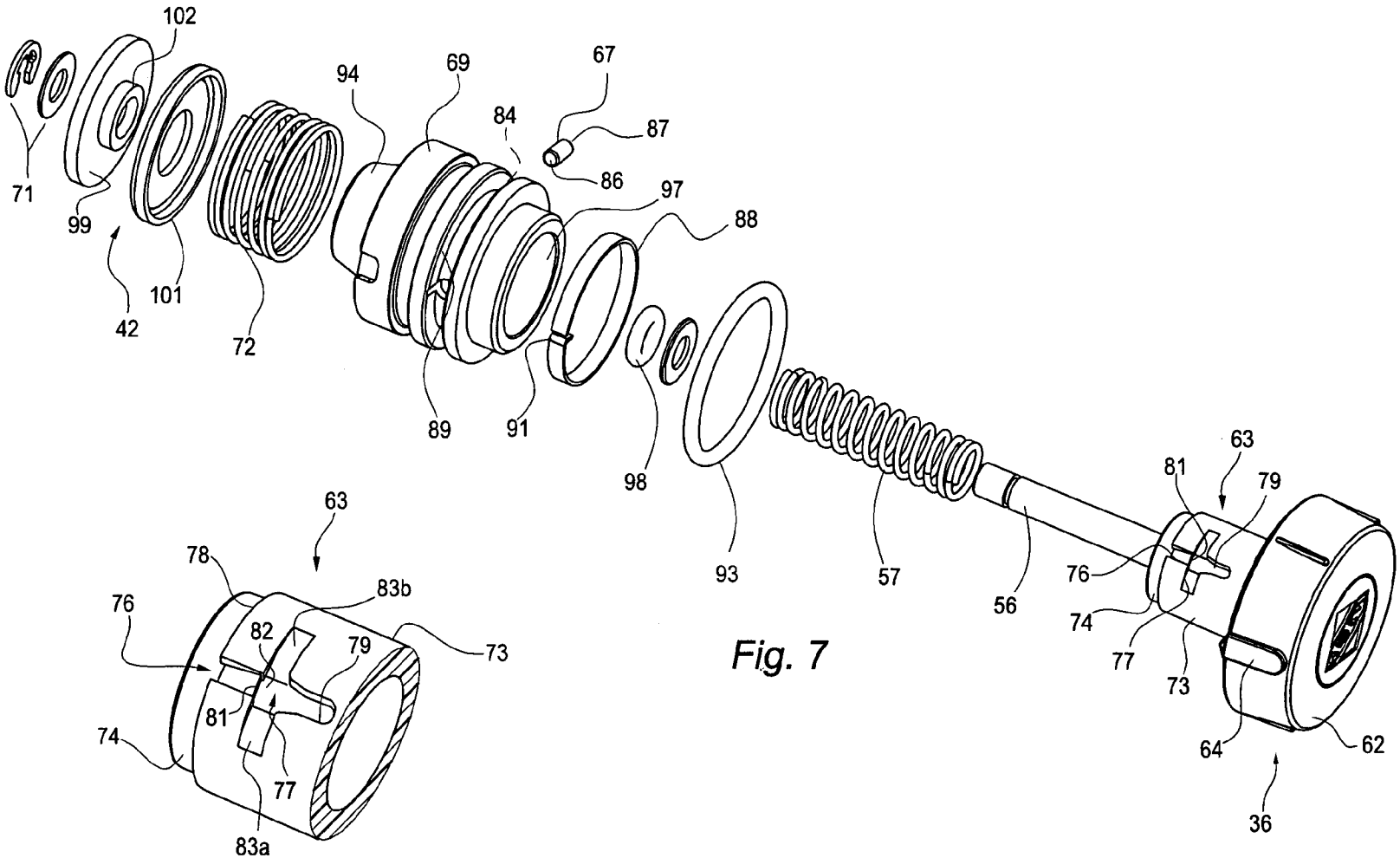
FIG. 7 represents an exploded view of the component group of FIG. 5.
FIG. 8 shows a detail, in enlarged scale, of the group of FIG. 7.
Figure 11:
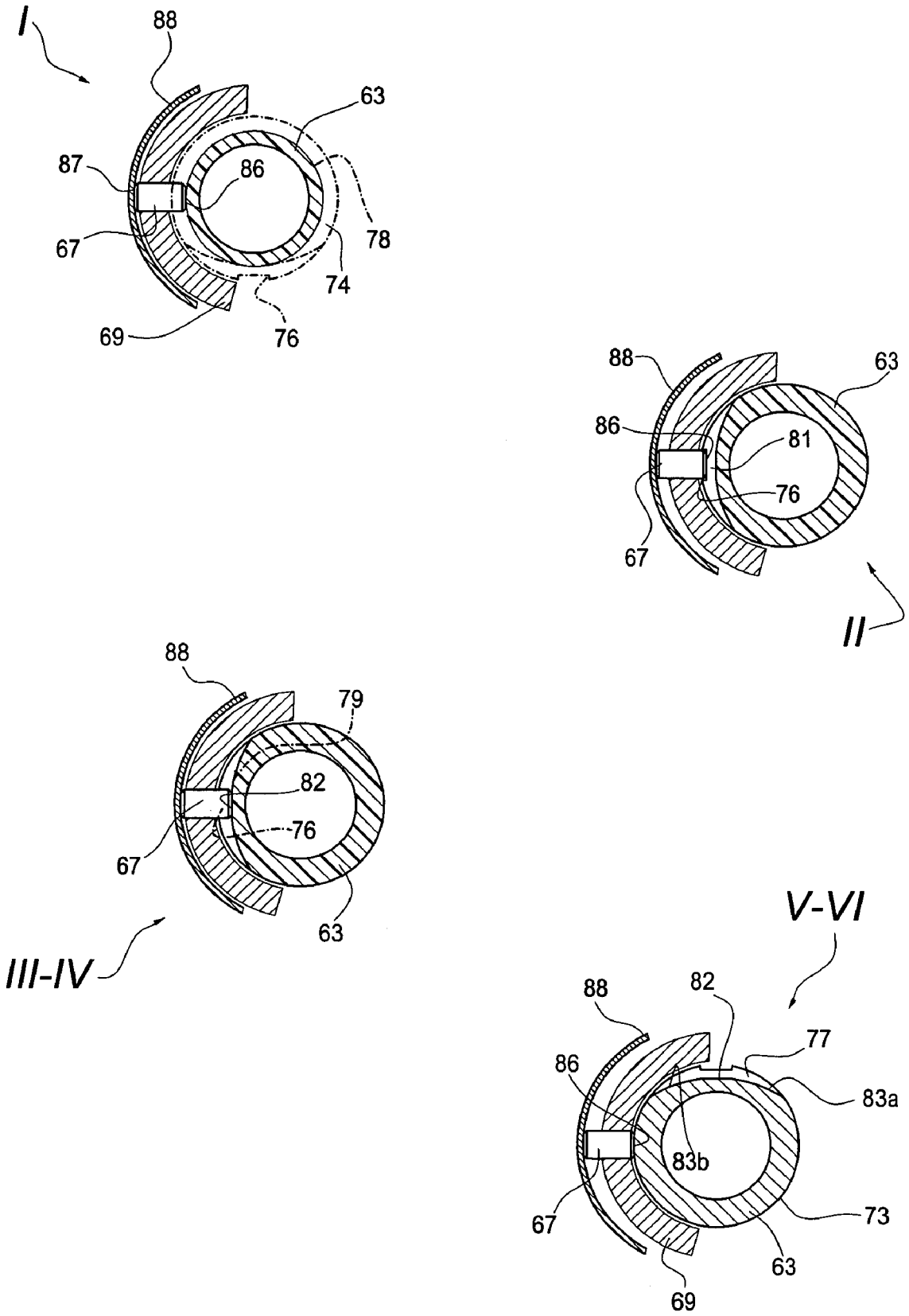
FIG. 11 shows, in enlarged scale, details of the section of FIG. 10 in different working configurations.

The rotation of the starting button 36 up to a reference start position causes the longitudinal notch 76 to be arranged in front of the pin element 67, as shown in the configuration "II" of FIG. 6 and FIG. 11, allowing the depression of the same button 36.

Now, depressing the starting button 36, the pin element 67 is forced to reenter in the seat 84 by the ascending section of the notch 76 against the action of the radially acting spring 88, up to the step section 81. The depression continuing, the spring 88 snap moves the pin element 67, positioning the inside end 86 on the basis section 82 and, in sequence, on the final section 79 of the longitudinal notch 76, according to the configuration "III" of FIG. 6 and the configurations "III-IV" of FIG. 11.

The following release of the starting button 36 causes a short lifting of the button 36 under the action of the return spring 57 (to see FIG. 9). The lifting is interrupted for the arrest of the step section 81 by the pin element 67 in a hooked position for the button 36. Here, as shown in the configurations "IV" of FIG. 6 and "III-IV" of FIG. 11, the pin element 67 engages the basis section 82 in the area of intersection between the notches 76 and 77.

A limited rotation of the starting button 36 in the hooking condition, out of the angular start position, causes the pin element 67 to reenter partially in the seat 84 for the action of the ascending section 83*a* or 83*b*. Anyway, it has no effect in the releasing of the button, in view of the remaining contrast on the pin element 67 practiced by the margin of the notch 77 coplanar to the step section 81. The rotation continuing over the extension of the transversal notch 77, the end 86 of the pin element 67 engages the cylindrical surface 73 according to the configurations "V" of FIG. 6 and "V-VI" of FIG. 11, whereby releasing the hub 63. Now, the return spring 57 moves the button 36 to the lifted position, of rest, as represented in the configuration "VI" of FIG. 6.

In the starting group 68 (FIGS. 3 and 7-10), the guide sleeve 69 is constituted by a cylindrical body 90 with a first annular notch 89 in which the seat 84 for the pin element 67 is also defined. The radially acting spring 88 is defined by a resilient annular leaf, shaped as a cut ring, lodged in the notch 89 and having a fold 91 engaged in a hole of the annular notch 89 and an operational section which urges the outside end 87 of the pin element 67.

The guide sleeve 69 is locked in a cylindrical hollow 92 of the valve body 33, whilst an "O" ring 93, in resilient material, interposed between a second annular notch of the body 90 and the cylindrical hollow 92, assures the gas seal. The sleeve 69 has a substantially frusto-conical terminal section 94 projecting from the body 90 and a cylindrical vane 96 formed in the body 90. The terminal section 94 defines the guide for the sliding of the stem 56 and the vane 96 is provided for guiding and receiving a portion of the hub 63.

The return spring 57 is partially lodged in the vane 96 (FIG. 9), around the stem 56, interposed between the bottom of the vane 96 and a seat 97 of the hub 63. Another "O" ring 98, in resilient material, lodged in a seat of the terminal section 94 and opposed through a washer by the spring 57 insures the gas seal between the sleeve 69 and the stem 56.

The cutoff shutter 42 includes a gastight disk 99, also in resilient material, and a spring holding disk 101. The gastight disk 99 has a surface opposed by the stop elements 71 and a hub 102 (see FIG. 3) slidably mounted along the actuating stem 56 and having capability of gastight.

The disk 101 is shaped for receiving an end of the holding spring 72 and is provided of a hole in which the hub 102 of the disk 99 is lodged. The intermediate portion of the spring 72 is arranged around the frusto-conical section 94 and the other end of the spring 72 is lodged in an annular seat at the base of the section 94.

Figure 3:
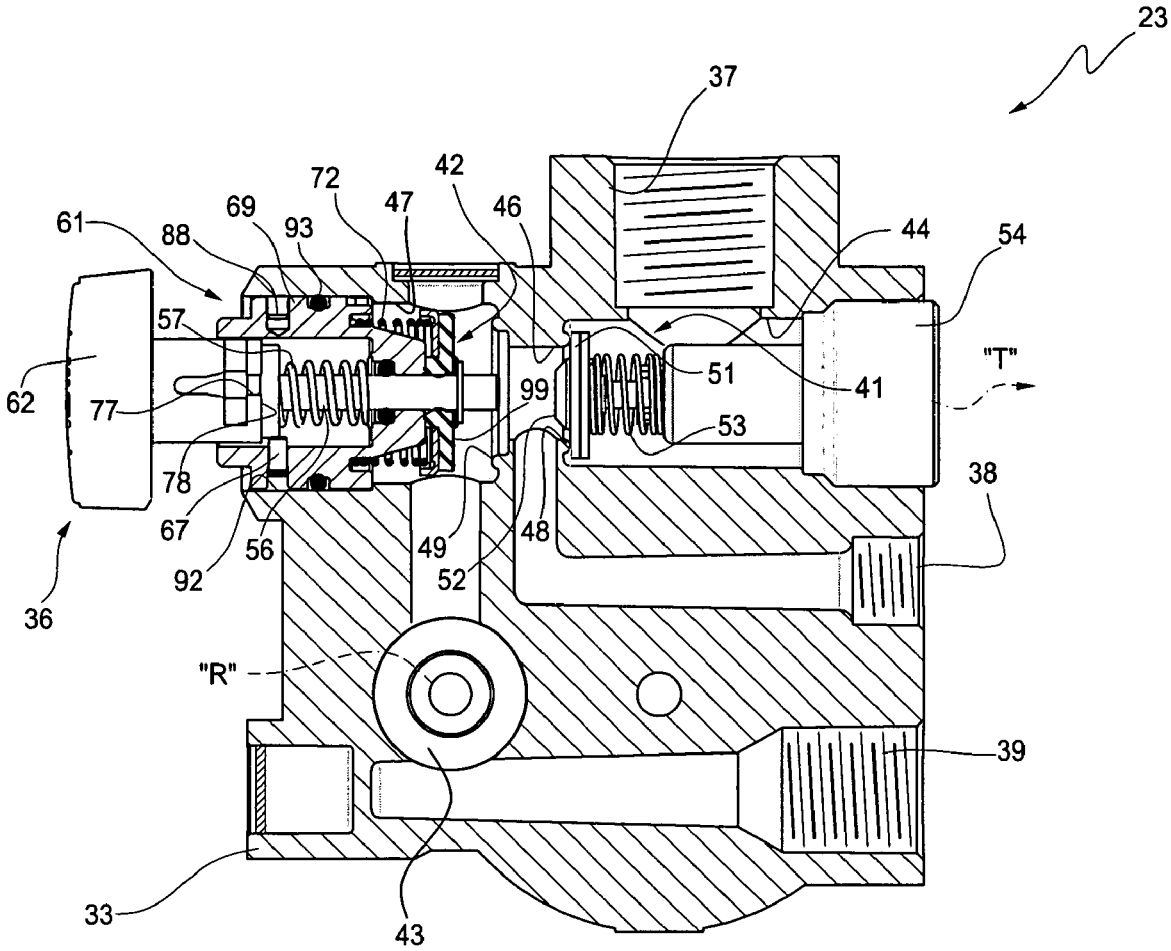
FIG. 3 represents a schematic section of the valve of FIG. 2.

The operation of the valve 23 and of the relative safety device 61 will result evident from the FIG. 3 and from the FIGS. 4*a*-4*d*.

In the safety device 61, as shown in FIG. 3, the starting button 36 is at rest in a lifted position in virtue of the return spring 57. Further, the action of the return spring 57 is prevailing and the spring 57 maintains compressed the holding spring 72. In the lighting valve 23, the cutoff shutter 42 is open, whilst the control shutter 41 is closed under the action of the spring 53. The gas of the input chamber 44 cannot flow in the intermediate chamber 44 and the starting button 36 cannot be depressed for the obstacle constituted by the pin element 67 to the annular shoulder 78 of the hub 63. It also prevents that the starting button 36 may be operated by child or inexperienced people.

Figure 4A:
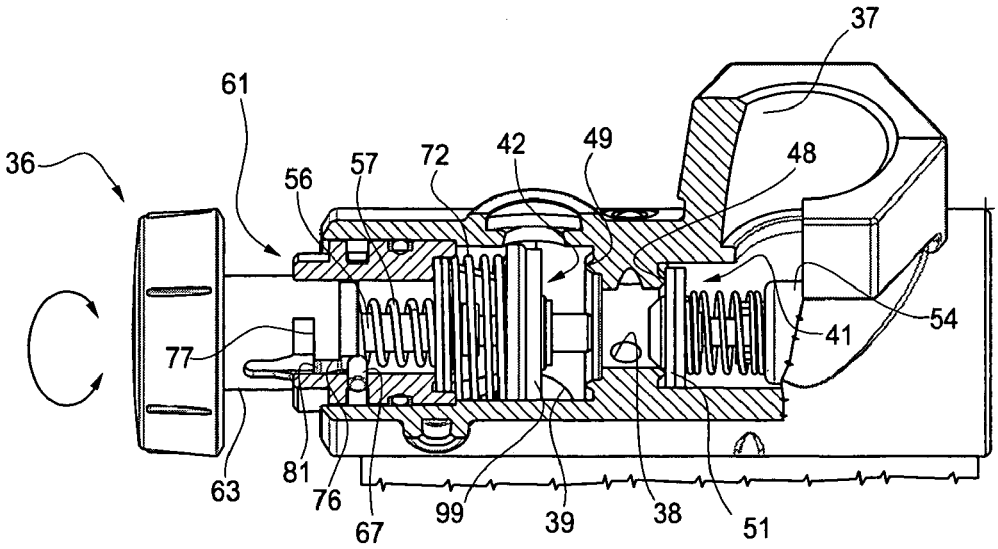
FIGS. 4*a*-4*d* show perspective schematic views of details of the valve of FIG. 2 in different working configurations.

In FIG. 4*a* the effects of a clockwise or counterclockwise rotation of the starting button 36 up to the angular start position are in evidence. The longitudinal notch 76 of the hub 63 is lined up with the pin element 67 and the button 36 can be freely depressed. This rotation does not produce effects on the other components, which remain in the same situation of FIG. 3.

Figure 4B:
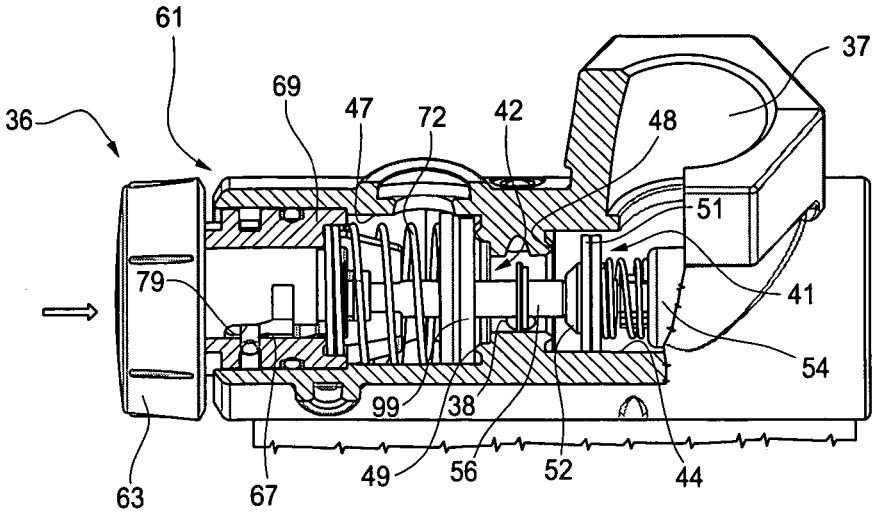

FIG. 4*b* shows the components of the device 61 of FIG. 3 when the starting button 36 is completely depressed beyond the position of start. During the depression, the actuating stem 56 shifts on the guide sleeve 69 toward the control shutter 41. For the action of the holding spring 72, the disk 99 of the shutter 42 follows the shift and slides along the stem 56, jointly with the extension of the holding spring 72. Reached the seat 49, the disk 99 is arrested and isolates the cutoff chamber 47.

The stroke of the starting button 36 continuing, the actuating stem 56 withdraws the gastight disk 51 from the seat 48 through the head 52. It puts in communication the intermediate chamber 46 with the input chamber 44, whilst the spring 72 maintains the gas seal of the disk 99 with the seat 49. The depression of the button 36 is limited by the end stop condition of the holding electromagnet 64. Now, the gas feeds the nozzle 17 through the duct 38 and the user can proceed to the lighting of the pilot light in the safe condition of cutoff of the main burner. As consequence of the lighting, the thermocouple energizes the electromagnet 54 with holding of its mobile portion and maintenance of the open condition of the control shutter 41.

Figure 4C:
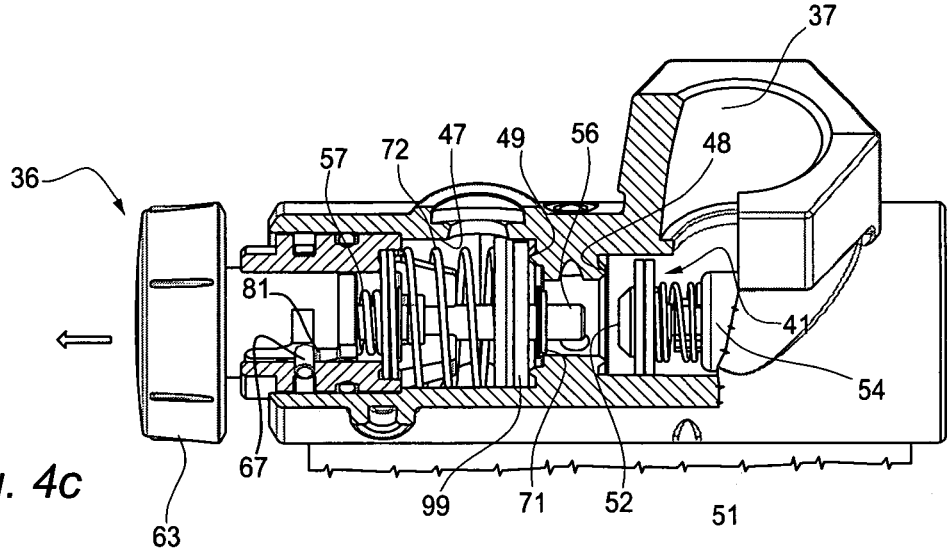

In FIG. 4*c*, the starting button 36 has been released but the pin element 67 maintains it hooked. The end of the stem 56 is spaced away from the seat 48 and it cannot practice any action on the head 52 of the gastight disk 51. The stop elements 71 are moved away from the seat 49, allowing the holding spring 72 to maintain the disk 99 adherent to the seat 49 and closed the intermediate chamber 47. In this state, whilst the gas continues to feed the pilot light, the flowing of the gas to the cutoff chamber 47 and the burner is still prevented. A possible turning off of the pilot light will cause only the closing of the control shutter 41 owing to the de-energization of the electromagnet 54.

Figure 4D:
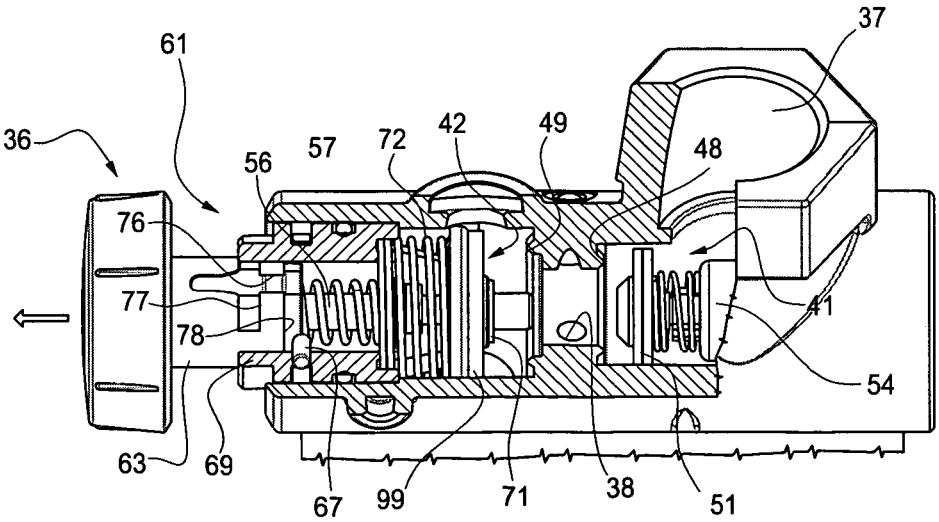
Figure 5:
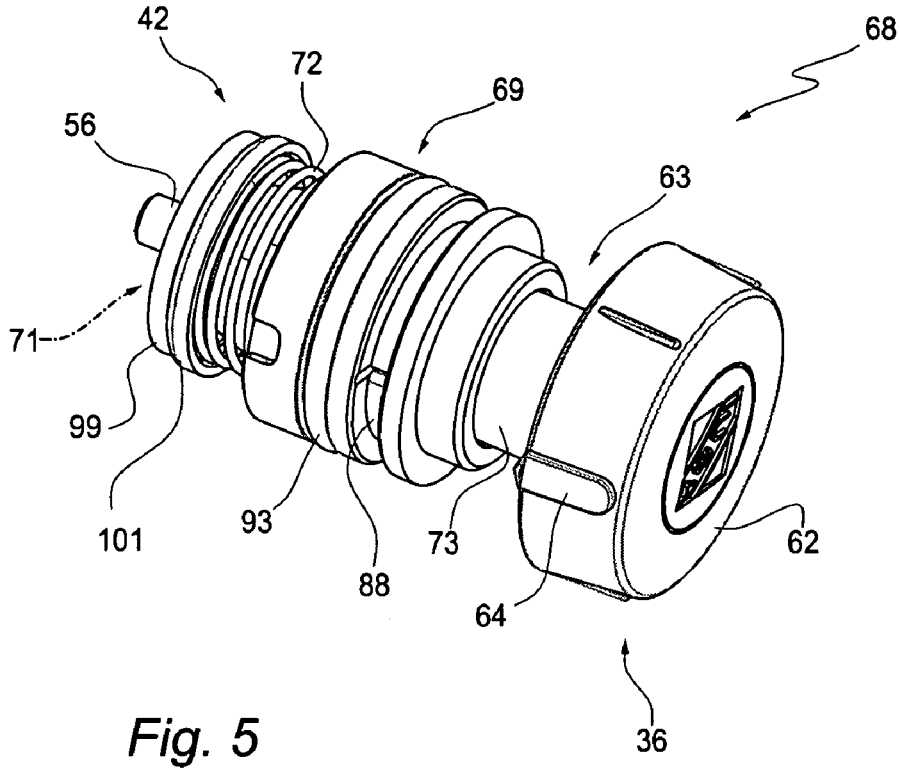
FIG. 5 represents, in a perspective view, a component group of the safety device according to the invention.

In FIG. 4*d* the effects of the application of a further clockwise or counterclockwise rotation of the starting button 36 beyond the angle of extension of the transversal notch 77 are shown. The releasing of the hub 63 allows the spring 57 to completely lift the button 36. The actuation stem 56 has been shifted with respect to the guide sleeve 69 and its end is further spaced away from the control shutter 41. In turn, the stop elements 71 have withdrawn the disk 99 from the seat 49 and compressed the holding spring 72, with consequent opening of the cutoff chamber 47. Thus, the gas can feed the burner 16 through the duct 39. As in FIG. 3, the pin element 67 is now in front of the shoulder 78 of the hub 63 preventing uncontrolled depressions of the button 36. Also in this case, a turning off of the pilot light will cause the closing of the control shutter 41 and the isolation of the intermediate chamber and of the duct for the pilot light.

Naturally, the principle of the invention remaining the same, the embodiments and the details of construction of the safety device for a lighting valve can be widely varied with respect to what has been described and illustrated, by way of non-limitative example, without by this departing from the ambit of the present invention.

The invention claimed is:

1. A safety device (61) for a lighting valve (23) of a gas burner (16), comprising a starting button (36) provided for depression, a return spring (57) for returning the starting button (36) to a lifted position, a cutoff shutter (42) controlled by the starting button (36) and arranged upstream of the burner (16), a control shutter (41) for a pilot light nozzle (17), and a holding electromagnet (54) for said control shutter (41)

wherein the control shutter (41) is normally closed and is actuatable through the starting button (36) for the flowing of the gas to the pilot light nozzle (17), whilst the holding electromagnet (54) is dependent on the pilot light to hold open said control shutter (41), said safety device (61) being characterized in that the starting button (36) is provided for rotation and can be depressed only for a given angular start position so that, for starting the lighting, the button (36) must be rotated up to said start position and subsequently depressed to close the cutoff shutter (42) and open the control shutter (41), whereby allowing the flowing of the gas to the pilot light nozzle (17);

said safety device (61) providing a hooking condition and an unhooked condition for the starting button (36), wherein, in the hooking condition, the cutoff shutter (42) is closed and the control shutter (41) is open under the control of the holding electromagnet (54) and without being influenced by the starting button (36); and wherein, in the unhooked condition, the starting button (36) can return to the lifted position under the action of the return spring (57) to open the cutoff shutter (42) for the flowing of the gas to the burner (16), said unhooked condition requiring a further rotation of the starting button (36) spaced away from said angular start position.

2. Safety device (61) according to claim 1, characterized in that it comprises a pin element (67) arranged in an angularly fixed position and which normally prevents the depression of the starting button (36), whilst said button (36) has a longitudinal notch (76), which can be lined up with the pin element (67) in said start position, and wherein the longitudinal notch (76) can slidably receive said pin element (67) for allowing the depression of the starting button.

3. Safety device (61) according to claim 2, characterized in that said pin element (67) is lodged in a seat of guide (84) with possibility of shifting toward a longitudinal axis of the button (36), whilst a radially acting spring (88) pushes the pin element (67) toward said axis;

wherein the longitudinal notch (76) is defined by two sides of guide and by a bottom, said bottom including an inclined ramp-like section, a descending step section (81) and a basis section (82) adjacent to the step section (81); and wherein, in the lifted position of the button (36), an end (86) of the pin element (67) projects from the seat (84) and, as soon as the staring button (36) lowers, said end (86) is caused to reenter in the seat (84) by the inclined ramp-like section and against the action of the radially acting spring (88);

the depression of the button (36) continuing, the radially acting spring (88) being provided for snap moving the pin element (67) from the step section (81) to said basis section (82), whereby determining the hooking condition of the starting button (36); and said pin element (67) constituting an arrest for said descending step section (81) such to prevent the return spring (57) to return the starting button (36) to its lifted position.

4. Safety device (61) according to claim 3, characterized in that the starting button (36) further includes a transversal notch (77), which crosses said longitudinal notch (76) adjacent to the step section (81) and provided for being employed by said pin element (67);

wherein said transversal notch (77) extends for a predetermined angle and has a bottom defined by said basis section (82) and by at least one transversal ascending section (83*a*, 83*b*) adjacent to said basis section; and wherein said predetermined angle is associated to the further rotation of the starting button (36) such that said further rotation causes the reentry of the pin element (67) in the seat (84) by said transversal ascending section with disengagement of the pin element from the transversal notch (77) in said unhooked condition.

5. Safety device (61) according to claim 1, characterized in that it is included in a starting group (68) which is mounted on a valve body (33), said group comprising an actuating stem (56) for the starting button (36) and a guide sleeve (69) for said stem (56) and in which the cutoff shutter (42) is slidably mounted on said stem and is arrested against stop elements (71) of the actuating stem by a holding spring (72) opposed by said sleeve (69).

6. Safety device (61) according to claim 3, characterized in that it is arranged in a starting group (68) comprising an actuating stem (56) for the starting button (36) and a guide sleeve (69) for said stem (56), and wherein the cutoff shutter (42) is slidably mounted on said stem and is arrested against stop elements (71) of the stem (56) by a holding spring (72) opposed by the sleeve, said seat of guide (84) being provided in the guide sleeve (69) and said radially acting spring (88) being mounted on said sleeve.

7. Safety device (61) according to claim 6, characterized in that the guide sleeve (69) comprises an annular notch (89) also defining said seat of guide (84) and in which the radially acting spring (88) is constituted by an elastic annular leaf lodged in said annular notch (89) and having a section (91) engaging in a hole of said annular notch and another section adapted to cooperate with another end of said pin element (67).

8. Safety device (61) according to claim 5, characterized in that the guide sleeve (69) is locked in a cylindrical hollow section (92) of the valve body (33) and in which there is provided a gastight "O" ring (93) interposed between an annular notch of the sleeve and said cylindrical section (92).

9. Safety device (61) according to claim (5), characterized in that it comprises a pin element (67) arranged in an angularly fixed position and which normally prevents the depression of the button (36), and wherein the starting button (36) has a longitudinal notch (76) which can be lined up with the pin element (67) in the said angular starting position, wherein said longitudinal notch (76) can slidably receive said pin element (67) for allowing the depression of the said button (36), and wherein the starting button (36) includes a hub (63) on which said notch (76) is formed, said guide sleeve (69) having a terminal section (94) with a guide for the sliding of the actuating stem (56) and a vane (96) adapted to receive a portion of said hub (63), the return spring (57) being lodged in said vane (96), around the stem, interposed between said terminal section (94) and a seat (97) of said hub (63).

10. Safety device (61) according to claim 9, characterized in that it further includes a gastight "O" ring (98), which is interposed between a gasket seat of the sleeve and said actuating stem (56) and wherein said gasket seat is obtained in said vane (96) and is opposed by the return spring (57) of the starting button (36).

11. Safety device (61) according to claim 5, characterized in that, in the hooking condition (FIG. 4C) of the starting button (36), the cutoff shutter (42) is disengaged from the stop elements (71) and closes a seat shutter (49) for the burner (16) under the action of its holding spring (72).

12. Safety device (61) according to claim 5, characterized in that the cutoff shutter (42) is formed by a gastight disk (99) in resilient material and by a spring holding disk (101), in which said gastight disk (99) includes a surface opposed by the said stop elements (71) and a hub (102), wherein said hub (102) is slidable in gastight manner along said actuating stem (56), and wherein the spring holding disk (101) is shaped for receiving an end of the holding spring (72) and provides a hole in which the hub (102) of the said gastight disk (99) is lodged.

13. Safety device (61) according to claim 5, characterized in that it is used in a lighting valve in which said control shutter (41) comprises a gastight disk (51) and a contrast head (52), wherein said gastight disk (51) is spring urged toward the position of closing and in which the contrast head is actuatable by the actuating stem (56) of the starting button (36) in its depressed position, said actuating stem (56) being spaced away from said contrast head (52) in the hooking position at the starting button (36).

14. Safety device (61) according to claim 5, characterized in that the valve body (33) comprises an inlet (37) for the input of the gas, an input chamber (44), an intermediate chamber (46), a cutoff chamber (47), a duct (38) for the pilot light, and an output duct (39) for the gas burner (16);

wherein the input chamber (44) is gas connected with said inlet (37), the duct for the pilot light is gas connected with said intermediate chamber (46), and the output duct (39) is gas connected with said cutoff chamber (47); and wherein the intermediate chamber (46) is interposed between the input chamber (44) and the cutoff chamber (47) and is gas connected with the input chamber (44) through a seat (48) for the control shutter (41), and with the cutoff chamber (47) through a seat (49) for the cutoff shutter (42);

in the condition of closing of the control shutter (41), the intermediate chamber (46) being gas insulated from the inlet (37) and, in the condition of closing of the cutoff shutter (42), the cutoff chamber (47) and the output duct (39) are insulated from the inlet (37).

15. A safety device (61) for a lighting valve (23) of a gas burner (16), comprising a starting button (36) and a return spring (57) for the starting button, said device being characterized in that it further comprises a hub (63), associated with the starting button (36) and having an annular shoulder (78), a longitudinal notch (76) which interrupts said annular shoulder and a transversal notch (77) which crosses said longitudinal notch;

a contrast element (67) arranged on the trajectory of depression of the hub (63) so as to normally prevent the depression of the button (36) and in which said longitudinal notch (76) can be lined up with the contrast element (67) for a predetermined angular start position of the button (36) so as to allow the depression of the said button (36);

a hooking section (81) in said longitudinal notch (76) engageable by said contrast element (67) to hold back in a hooking condition said button (36) against the action of the return spring (57); and an unhooking section (ascending sections 83*a* and 83*b*) in said transversal notch (77) engageable by the contrast element in response to a further rotation of the starting button (36) for an action of disengagement from the hooking section (81) which allows the lifting of the starting button (36) by the return spring (57).

16. Safety device (61) for a lighting valve (23) according to claim (15) further comprising a control shutter (41) which is actuatable through the starting button (36), a holding electromagnet (54) for said shutter depending on the pilot light and a cutoff shutter (42) depending on the starting button (36) and arranged upstream of the burner (16), the said device being characterized in that the depression of the starting button (36) allowed by the longitudinal notch (76) ensures the opening of the control shutter (41) for the lighting of the pilot light; and the hooking condition puts the starting button (36) in an operational state in which the cutoff shutter (42) is closed and the control shutter (41) is open under the control of the holding electromagnet (54);

the lifting of the button (36) by the return spring (57), after the unhooking, ensuring the opening of the cutoff shutter (42) for the flowing of the gas to the burner (16) and under the control of the pilot light.

* * * * *